US006044995A

United States Patent [19]

Dai

[11] Patent Number: 6,044,995

[45] Date of Patent: Apr. 4, 2000

[54] NEGATIVE-PRESSURE-RESISTIBLE LEAKAGE-PROOF BOTTLE COVER

[75] Inventor: Keith Hon-Chuan Dai, Taichung, Taiwan

[73] Assignee: Taiwan Hon Chuan Enterprise Co., Ltd., Taichung, Taiwan

[21] Appl. No.: 09/158,139

[22] Filed: Sep. 22, 1998

[51] Int. Cl.[7] ..... B65D 41/34

[52] U.S. Cl. ..... 215/354; 215/341; 215/252

[58] Field of Search ..... 215/354, 252, 215/320, 341, 342, 343, 349, 350

[56] References Cited

U.S. PATENT DOCUMENTS

| | | | |
|---|---|---|---|
| 3,433,380 | 3/1969 | Kawchitch . | |
| 3,462,034 | 8/1969 | Friedberg . | |
| 3,869,059 | 3/1975 | Ellis | 215/320 |
| 4,016,996 | 4/1977 | Aichinger et al. . | |
| 4,090,631 | 5/1978 | Grussen | 215/341 X |
| 4,200,196 | 4/1980 | Bashour | 215/320 X |
| 5,421,470 | 6/1995 | Dudzik | 215/350 |
| 5,573,128 | 11/1996 | Tsujiguchi et al. | 215/252 |
| 5,913,436 | 6/1999 | Breuer | 215/252 |

*Primary Examiner*—Allan N. Shoap
*Assistant Examiner*—Robin A Hylton
*Attorney, Agent, or Firm*—Bacon & Thomas

[57] ABSTRACT

A negative-pressure-resistible leakage-proof bottle cover, wherein a leakage-proof gasket is disposed. A circular main body of the leakage-proof gasket is stuck onto inner top face of a cover body, wherein an extended positioning circumferential edge is commensurate with a confining stopper of the cover body. The bottom face of the leakage-proof gasket is extended to form an infiltration resister, whereof the open end is further extended in out- and- up direction to form an infiltration-resisting ring. At a lower portion of the cover body, an anti-tampering ring is arranged, wherein a plurality of seamless cutting lines is round-set and a bridge point is formed in each of the seamless cutting lines. In the anti-burglar ring, a plurality of protruded stopping pieces is disposed, wherein between two neighboring protruded stopping pieces, a consecutive wall is extended from an inner edge of the anti-tampering ring, and further, the consecutive wall is pinched by and connected to two neighboring protruded stopping pieces.

1 Claim, 5 Drawing Sheets

NEGATIVE-PRESSURE-RESISTIBLE LEAKAGE-PROOF BOTTLE COVER

BACKGROUND OF THE INVENTION

The invention relates to a bottle cover and, more particularly, to the structure of a negative-pressure-resistible leakage-proof bottle cover.

The structure of a common bottle cover is shown in FIGS. 1 and 2. A plurality of threads are formed at an inner edge of a cover body serving as a female connector to match those on a bottle mouth serving as a male connector for a firm engagement. In the cover body, an anti-tampering ring is provided at a lower position and a leakage-proof gasket is provided on an inner top face.

The leakage-proof gasket is circular and formed from an elastomer that is processed from thermoplastic materials. It is designed thicker at the circumference than at the center. The circumferential portion is bent downward and is slightly extended and converged to form a single circular edge to deform at protrusions on an inner wall of the bottle body for positioning when the leakage-proof gasket is pressed onto the inner top face of the bottle cover.

This known leakage-proof gasket has a disadvantage in that the gasket is thickened at its circumference, and since both the contact faces of the gasket and the top edge of a bottle mouth are planer, a relatively larger torque force will be required for sealing the bottle mouth. It is rather a inconvenient, or even harmful to a user. In case a bottle filled with a beverage at 85° C. or higher becomes cold, a negative pressure will be created in the bottle, so that air will infiltrate into the bottle. This is why a common bottle cover cannot withstand the effect of negative-pressure.

The integral molded anti-tampering ring located around the open end of the cover body with a relatively smaller inner diameter than that of the opening, connects to the cover body via intermittently spaced gaps and strips. Several choke fins are round-set at an inner side of the anti-tampering ring for clutching at the bottom edge of threads formed at an outer side of the bottle mouth. The thickness of the anti-tampering ring is about equal to that of the cover body, and, when sealing, the ring is subjected to downward and outward pressures from the cover body and threads at the bottle mouth. It cannot pass smoothly over the threaded section and may become deformed and torn. The intermittently spaced strips are liable to be broken.

SUMMARY OF THE INVENTION

The invention provides a negative-pressure-resistible leakage-proof gasket equipped bottle cover, wherein the leakage-proof gasket offers a function of dual-stage leakage-proofing and negative-pressure-resisting.

Another objective of the invention is to provide a negative pressure-resistible leakage-proof gasket equipped bottle cover and, wherein the anti-tampering ring is located at lower portion of the bottle cover where it cannot be easily broken.

To realize the above objects of the invention, there is provided on the inner top face of the cover body, a leakage-proof gasket circular gasket having a positioning circumferential edge commensurate with a confining stopper in the cover body. An infiltration resister is extended downward from a bottom face of the gasket for a length, then bent in an outwardly and upwardly direction to form an infiltration-resisting ring. An anti-tampering ring with a plurality of seamless cutting lines is provided at a lower portion of the cover body, wherein a bridge point is formed in each cutting line. In the anti-tampering ring, a plurality of protruded stopping pieces are formed and a consecutive wall is provided between to neighboring protruded stopping pieces extending from an inner edge of the anti-tampering ring.

DETAILED DESCRIPTION OF THE PREFERRED EMBODIMENT

Figure 1:
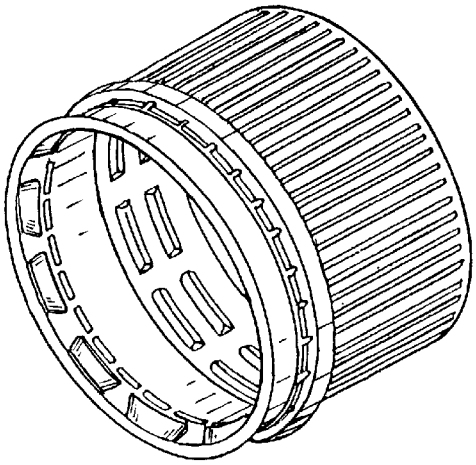
Fig. 1 PRIOR ART
FIG. 1 is a perspective view of a known common bottle cover.
Figure 2:
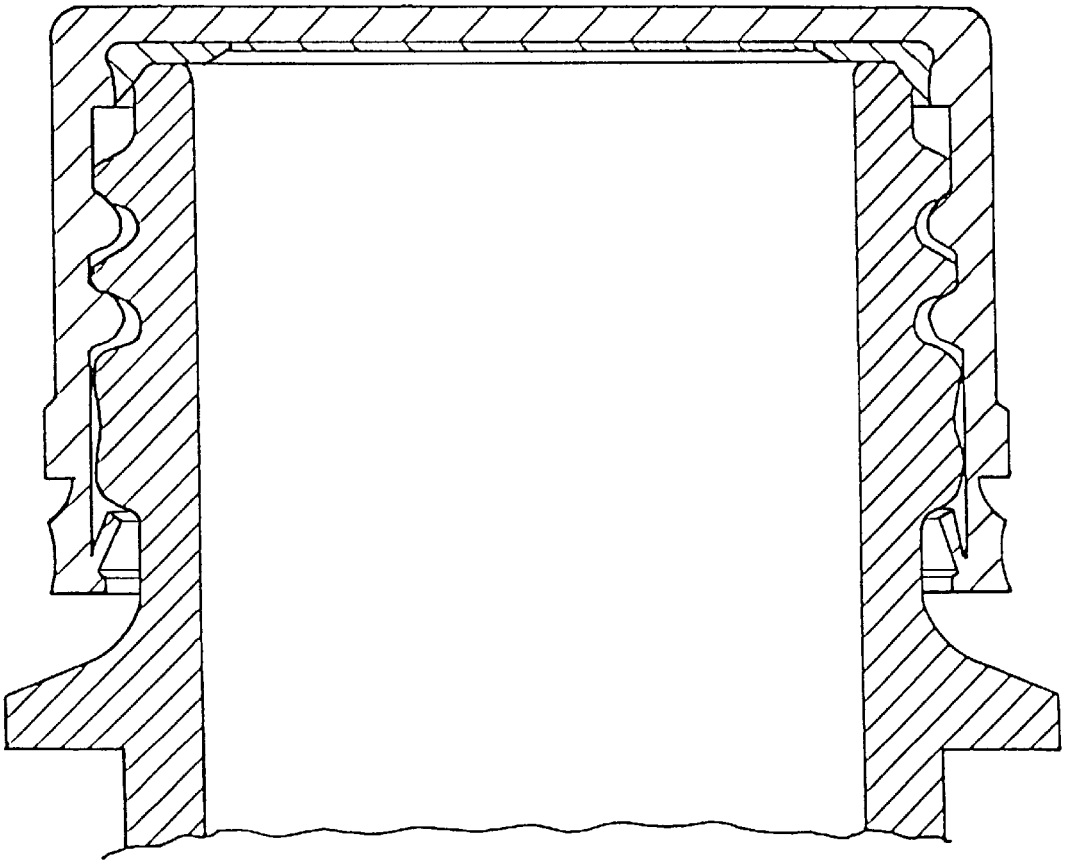
Fig. 2 PRIOR ART
FIG. 2 is a sectional view showing the combination of a known bottle cover and a bottle mouth.
Figure 3:
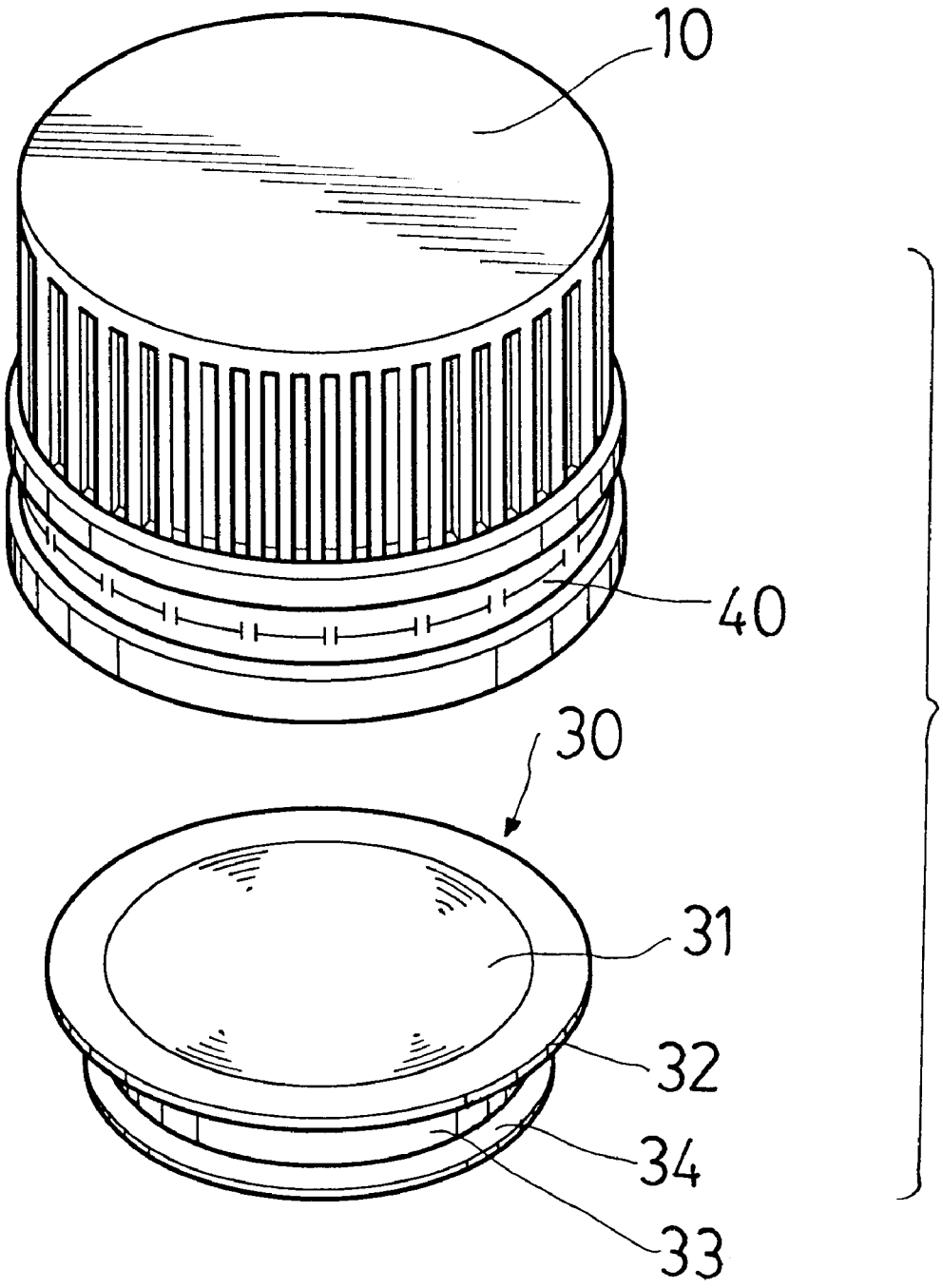
FIG. 3 is an exploded perspective view of the invention.
Figure 4:
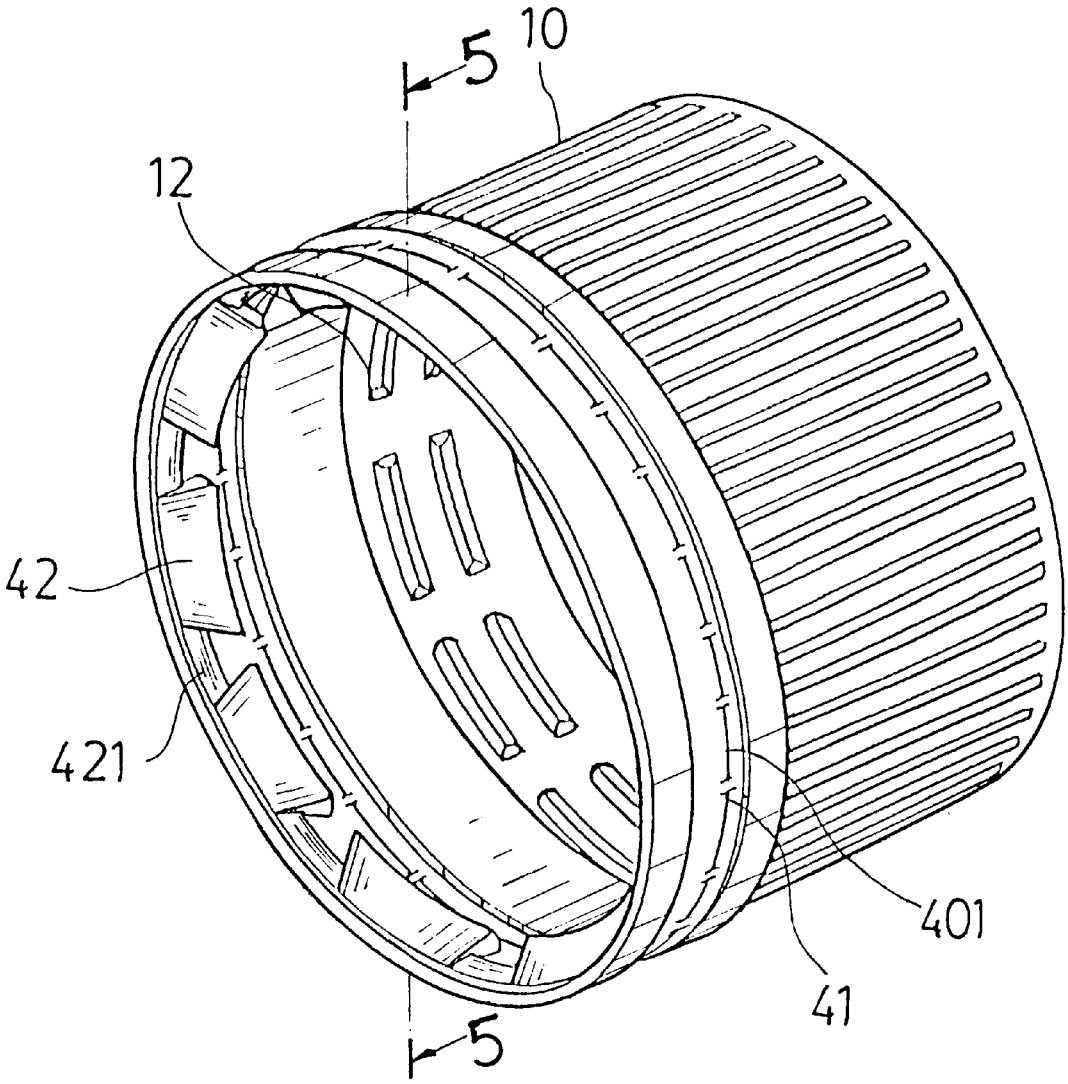
FIG. 4 is a perspective view of the invention.
Figure 5:
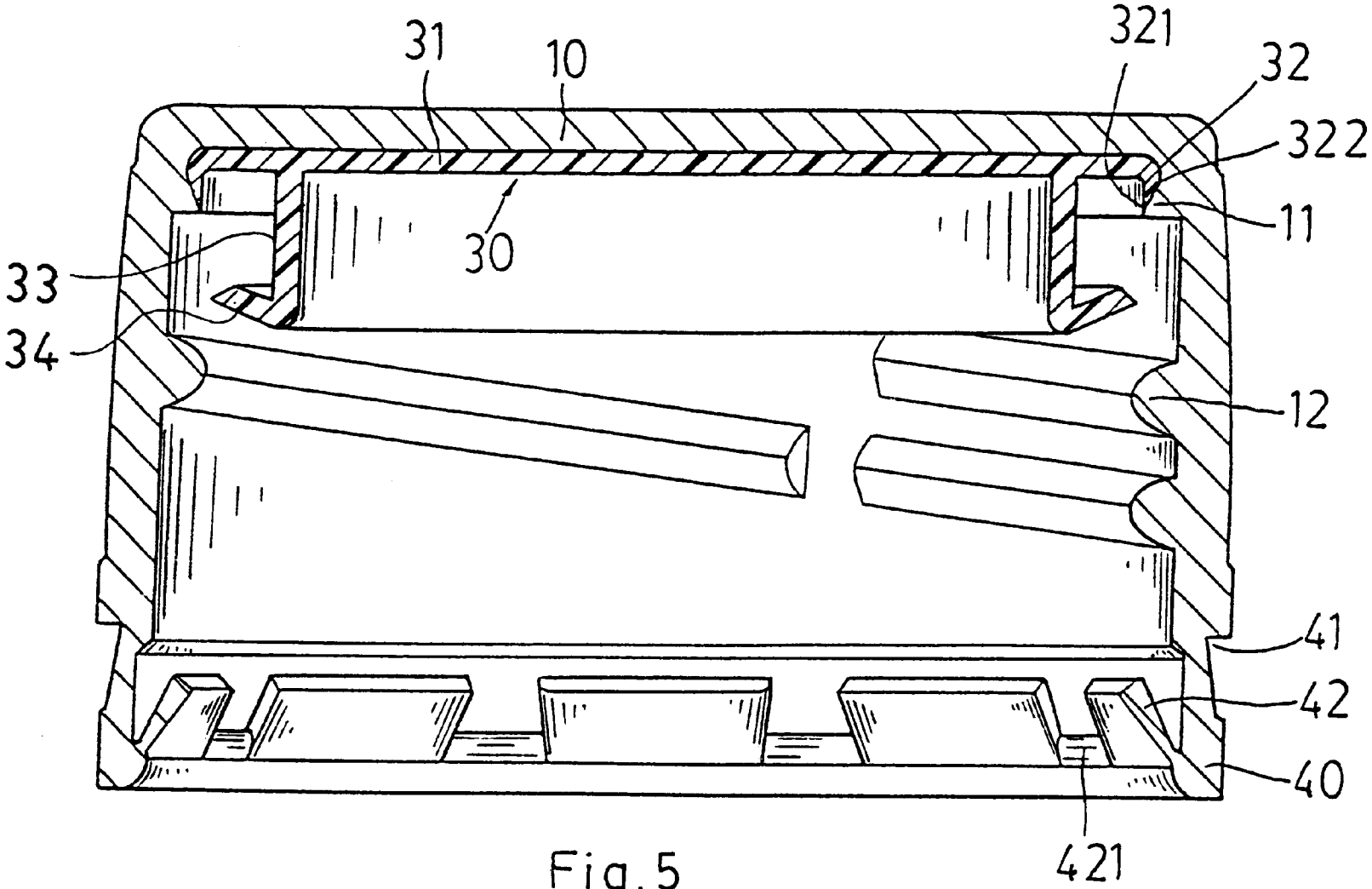
FIG. 5 is a sectional view along the line 5—5 in FIG. 4.
Figure 6:
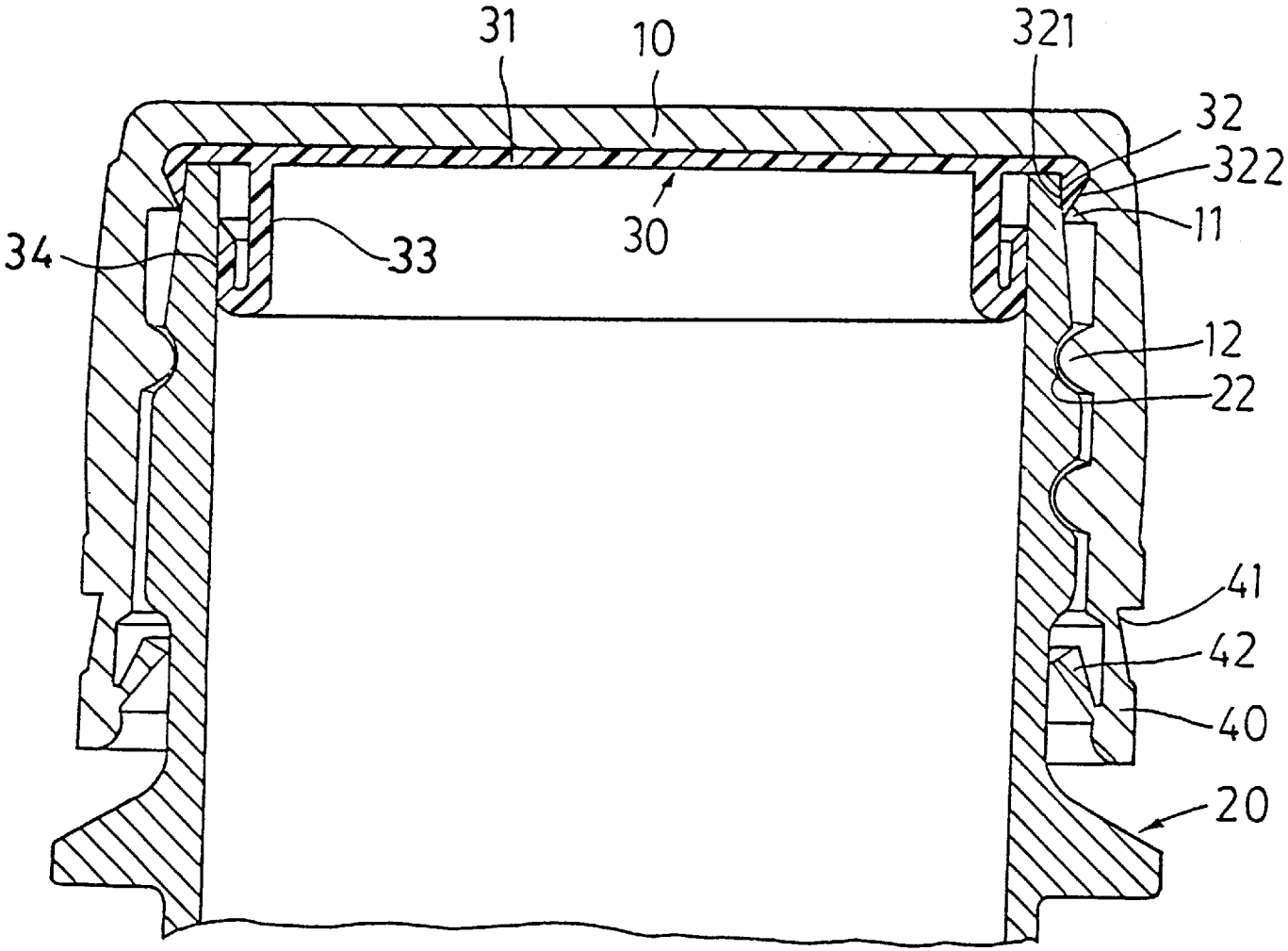
FIG. 6 is a sectional view showing the combination of the invention and a bottle mouth.

As shown in FIGS. 3 through 6, the structure of a bottle cover of the invention mainly comprises a cover body 10, an integral molded anti-tampering ring 40 at a lower portion of the cover body 10, a confining stopper 11 viewed as a triangular protrusion in cutaway section on an inner wall near the top end of the cover body 10, and a plurality of threads 12 on a side wall of the cover body 10 corresponding with a plurality of threads 22 formed along an outer side of a bottle mouth 21 of a bottle body 20.

A leakage-proof gasket 30 is made from an elastic material, a material different from that of the cover body 10, and having a circular main body 31 at outer diameter corresponding to the inner diameter at the top of the cover body 10. Gasket 30 is disposed on an inner top face of the cover body 10. The circumferential edge of the circular main body 31 is bent and extended downward to form a positioning circumferential edge 32, wherein an inner plain face 321 is substantially perpendicular to the circular main body 31, while an outer side face 322 is sloped to match the confining stopper 11. When the leakage-proof gasket is pressed onto the inner top face of the integral molded cover body 10, the sloped face 322 corresponds with the confining stopper 11 for purpose of positioning. The bottom face of the leakage-proof gasket 30 is located at a position corresponding to that of an inner edge of the bottle mouth 21 and is extended downward to form an infiltration resister 33, which is further extended from its open end in an outward and upward direction to form an infiltration- resisting ring 34.

A plurality of seamless cutting lines 401 are provided between an anti-tampering ring 40 and the cover body 10, and a bridge point 41 is provided between each two seamless cutting lines 401. The anti-tampering ring 40 being slightly longer than the cover body 10 in inner diameter, but thinner in thickness, is extended from an inner face at its open end in an inwardly and upwardly direction to form a plurality of stopping pieces 42.

A plurality of consecutive walls 421 with same thickness as that of the protruded stopping pieces 42 are extended from inner edge of the anti-tampering ring 40. Each consecutive wall 421 connects two neighboring protruded stopping pieces 42 side by side to form a serial root connection.

In sealing the cover body 10 to the bottle mouth 21, the top edge of the bottle mouth 21 engages and deforms the infiltration-resisting ring 34 and urges same toward the infiltration resister 33. After sealing is made, the top edge of the bottle mouth 21 will locate at a position between the positioning circumferential edge 32 and the infiltration resister 33. Meanwhile, the outer edge of the bottle mouth 21 engages intimately against the plain face 321 at the inner side of positioning circumferential edge 32, and the infiltration-resisting ring 34 sticks firmly against the inner wall of the bottle mouth 21 due to the elastic restoring force of ring 34. The ends of the protruded stopping pieces 42 are urged against the lowest position of the thread section of the bottle mouth 21.

Due to a dual connection of the protruded stopping pieces 42 to the cover body 10, including root connection to the inner edge of the cover body 10 and a mutual connection via the consecutive walls 421, the construction will not be broken or destroyed easily by a squeezing or pulling force during sealing of the cover body 10 onto the bottle mouth 21 or removal after the molding process. After sealing, each free end of the protruded stopping pieces 42 engaging the thread section of the bottle mouth 21 at the lowest position will effectively prevent the cover body 10 from falling off. The bridge points 41 will be fractured for easy opening as soon as the cover body 10 is turned. The seamless cutting lines 401 are formed for detachment of the anti-tampering ring 40 from the cover body 10 for an easy opening. During sealing, because of downward pressure from the cover body 10, the seamless cutting lines 401 contract to allow contact of the anti-tampering ring 40 to the round edge of the cover body 10 and relieve loading at the bridge points 41 to avoid fracture.

The invention provides a dual function leakage-proving. The infiltration-resisting ring 34 is elastically attached firmly to the inner edge of the bottle mouth 21 to prevent the air in the bottle from escaping through any opening in the leakage-proof gasket 30 to ensure the first stage leakage-proofing. The plain face 321 at the inner side of the positioning circumferential edge 32 attached firmly to the outer edge of the bottle mouth 21, and the slope 322 being commensurate with the confining stopper 11, together form a barrier for the second stage leakage proofing. With the dual protection measures, it is possible to reduce the torque force required to open a bottle and to ensure an excellent sealing for keeping foods fresh and safe.

In addition, the leakage-proof gasket 30 of the invention is capable of withstanding a negative pressure. In the event the bottle body 20 is filled with hot foods at 85° C. or higher, a negative pressure in the bottle will be created when the temperature is reduced. Then, the outside air shall attempt to infiltrate into the bottle through any openings available between the cover body 10 and the bottle mouth 21, due to the relatively larger atmospheric pressure. However, because of the tight squeezing of the slope 322 of the positioning circumferential edge 32 against the confining stopper 11, the outside air is prevented from entering the first stage negative-pressure-resistance effect. Further, the infiltration-resisting ring 34 can also resist a negative pressure because the elastic restoring force of the infiltration-resisting ring 34 urges the ring 34 against the inner edge of the bottle mouth 21, so that, even if some air exists between the infiltration resister 33 and the infiltration-resisting ring 34, the pressure produced will further push the infiltration-resisting ring 34 against the inner edge of the bottle mouth 21 and prevent the outside air from entering.

What is claimed is:

1. A negative-pressure-resistible leakage-proof bottle cover, comprising:

a cover body, a leakage-proofgasket disposed on an inner top face in said cover body, said leakage-proof gasket having a circular main body with an outer diameter corresponding to an inner diameter of the top face of said cover body, said circular main body having a circumferential edge turned downward and extended to form a positioning circumferential edge, said positioning circumferential edge having an inner face at an inner side and a sloped face at an outer side, said leakage-proof gasket having a bottom face extended downward to form an infiltration resister, said infiltration resister having an open end extended in an outward and upward direction to form an infiltration-resisting ring; and an anti-tampering ring disposed circumferentially around an open end of said cover body and having a plurality of oblique protruded stopping pieces arranged at an inner edge thereof, a plurality of cutting lines disposed between said anti-tampering ring and said cover body, each of said seamless cutting lines having a bridge point, a consecutive wall being extended from an inner edge of said anti-tampering ring between each two adjacent protruded stopping pieces, said consecutive wall being pinched by and connected to adjacent protruded stopping pieces in a side by side manner to form a serial connection at the roots of said protruded stopping pieces.

* * * * *